US008545275B2

(12) United States Patent
Wang et al.

(10) Patent No.: US 8,545,275 B2
(45) Date of Patent: Oct. 1, 2013

(54) ELECTRICAL CONNECTOR WITH TOUCH-SAFETY CONTACT STRUCTURES

(75) Inventors: Chin-Li Wang, Jhonghe (TW); Ya-Hui Shen, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 288 days.

(21) Appl. No.: 12/961,232

(22) Filed: Dec. 6, 2010

(65) Prior Publication Data

US 2011/0250769 A1 Oct. 13, 2011

(30) Foreign Application Priority Data

Apr. 7, 2010 (CN) ..... 2010 1 0162754
Apr. 7, 2010 (CN) ..... 2010 1 0162786

(51) Int. Cl.
*H01R 13/04* (2006.01)

(52) U.S. Cl.
USPC ..... 439/693; 439/680; 439/732

(58) Field of Classification Search
USPC ..... 439/693, 106, 181, 682, 680, 732
See application file for complete search history.

(56) References Cited

U.S. PATENT DOCUMENTS 1,157,026 A * 10/1915 Meschenmoser ..... 439/252
2,537,370 A * 1/1951 Parnes ..... 439/693
2,655,638 A * 10/1953 Allen ..... 439/271
2,716,737 A * 8/1955 Maberry ..... 439/176
2,983,895 A * 5/1961 Pasik ..... 439/581
2,992,401 A * 7/1961 Lewis ..... 439/212
3,239,791 A * 3/1966 Fyrk ..... 439/144
3,277,424 A * 10/1966 Nelson ..... 439/205
3,430,187 A * 2/1969 de Man et al. ..... 439/462
3,643,210 A * 2/1972 Fujita ..... 439/687
3,662,296 A * 5/1972 Newman ..... 439/135
3,742,424 A * 6/1973 Startin ..... 439/678
3,757,274 A * 9/1973 Hazelhurst ..... 439/281
3,832,674 A * 8/1974 Florian ..... 439/281
3,845,451 A * 10/1974 Neidecker ..... 439/295
3,851,946 A * 12/1974 Piaget et al. ..... 439/347
3,888,559 A * 6/1975 Geib ..... 439/258
3,932,020 A * 1/1976 Gilbert, Jr. ..... 439/675
4,045,113 A * 8/1977 Iacono ..... 439/578
4,084,875 A * 4/1978 Yamamoto ..... 439/274
4,455,056 A * 6/1984 Herrmann et al. ..... 439/347
4,634,208 A * 1/1987 Hall et al. ..... 439/607.51
4,806,123 A * 2/1989 Konishi et al. ..... 439/595

(Continued)

FOREIGN PATENT DOCUMENTS

CN 201303171 Y 9/2009
EP 1703597 A1 9/2006

*Primary Examiner* — Neil Abrams
(74) *Attorney, Agent, or Firm* — Sughrue Mion, PLLC

(57) ABSTRACT

An electrical connector with touch safety contact structure. The connector includes an insulative housing, a contact and at least one protecting insulator. The insulative housing defines a mating direction, a mating face and a receiving cavity recessed from the mating face along the mating direction. The contact is received in the insulative housing and includes a contacting portion exposed into the receiving cavity, a retaining portion extending from one end of the contacting portion to be interferentially received in the insulative housing, and a forward end extending from the other end of the contacting portion to locate more closely to the mating face of the insulative housing than the contacting portion, and a connecting portion extending from the retaining portion to be exposed beyond the insulative housing. The protecting insulator covers the forward end of the contact. An additional grounding contact assembled to the insulative housing may be included.

11 Claims, 17 Drawing Sheets

(56) References Cited

U.S. PATENT DOCUMENTS

| | | | | | |
|---|---|---|---|---|---|
| 4,818,237 | A * | 4/1989 | Weber | 439/693 |
| 5,015,195 | A * | 5/1991 | Piriz | 439/318 |
| 5,147,228 | A * | 9/1992 | Miller et al. | 439/741 |
| 5,167,518 | A * | 12/1992 | Deacon | 439/188 |
| 5,173,063 | A * | 12/1992 | Barkus et al. | 439/681 |
| 5,176,528 | A * | 1/1993 | Fry et al. | 439/181 |
| 5,588,852 | A * | 12/1996 | Puerner | 439/135 |
| 5,703,324 | A * | 12/1997 | Harder | 174/21 C |
| 5,752,856 | A * | 5/1998 | Boutin et al. | 439/620.29 |
| 5,916,002 | A * | 6/1999 | Gottschalk et al. | 439/839 |
| 5,921,823 | A * | 7/1999 | Bernardini | 439/889 |
| 5,993,253 | A * | 11/1999 | Sai | 439/578 |
| 6,113,436 | A * | 9/2000 | Kuwahara et al. | 439/693 |
| 6,146,211 | A * | 11/2000 | Okamoto et al. | 439/693 |
| 6,325,633 | B1 * | 12/2001 | Ito et al. | 439/34 |
| 6,336,821 | B1 * | 1/2002 | Hattori | 439/282 |
| 6,368,121 | B1 * | 4/2002 | Ueno et al. | 439/108 |
| 6,857,887 | B1 * | 2/2005 | Belson et al. | 439/181 |
| 6,860,746 | B2 * | 3/2005 | Ota et al. | 439/181 |
| 6,918,800 | B2 * | 7/2005 | Ota et al. | 439/886 |
| 6,945,826 | B2 * | 9/2005 | Wise | 439/693 |
| 7,057,111 | B2 * | 6/2006 | Fung et al. | 174/74 R |
| 7,140,925 | B2 * | 11/2006 | Allison et al. | 439/680 |
| 7,192,313 | B2 * | 3/2007 | Sai | 439/660 |
| 7,374,460 | B1 * | 5/2008 | Hariharesan et al. | 439/679 |
| 7,597,573 | B2 * | 10/2009 | Defibaugh et al. | 439/206 |
| 7,674,137 | B2 * | 3/2010 | Sato | 439/693 |
| 7,946,871 | B1 * | 5/2011 | Yu et al. | 439/181 |
| 8,062,041 | B2 * | 11/2011 | Nakamura | 439/108 |
| 8,133,077 | B2 * | 3/2012 | Okamoto | 439/607.54 |
| 8,182,278 | B2 * | 5/2012 | Kataoka et al. | 439/266 |
| 8,298,022 | B2 * | 10/2012 | Tsuruta et al. | 439/886 |
| 2008/0261420 | A1 * | 10/2008 | Riddle | 439/134 |
| 2011/0250769 | A1 * | 10/2011 | Wang et al. | 439/108 |
| 2013/0143448 | A1 * | 6/2013 | Eckel et al. | 439/686 |

* cited by examiner

ELECTRICAL CONNECTOR WITH TOUCH-SAFETY CONTACT STRUCTURES

BACKGROUND OF THE INVENTION

1. Field of the Invention

The present invention relates to an electrical connector and an electrical connector assembly, more particularly to an electrical connector and an electrical connector assembly for power transmission.

2. Description of Related Art

Electrical connectors are widely used today. In general, electrical connectors can be classified into personal use and industrial use. When in personal use, electrical connectors can be classified as desktop connectors, laptop connectors, mobile phone connectors, consuming connectors, and other types. When in industrial use, electrical connectors can be used in industrial computers, servers, and workstations. Power connector is one common kind of electrical connector used in different equipments. Usually, a plug-type power connector and a receptacle-type power connector mate with each other to supply power to the equipments. Contacts of the plug connector and the receptacle connector contact one another to form electrical connection.

China Patent No. CN200820212432.9 disclosed a plug connector and a receptacle connector mating with each other for power transmission. The plug connector comprises a plug insulative housing and a plurality of plug contacts received in the plug insulative housing for power transmission. The plug insulative housing defines a receiving cavity for receiving the receptacle connector. The plug contact is of slice structure and extends into the receiving cavity for electrically connecting with the receptacle connector. Since the slice-shape plug contacts are exposed into the receiving cavity directly without any protection to contacting ends thereof, the contacting ends are prone to be contacted when in improper use status. Therefore, electric shock phenomenon has great possibility to be generated and the contacting ends are easy to be polluted or damaged. It is more serious when the connectors are used for high-power, high-voltage situations.

Europe Patent No. EP1703597A1 disclosed a power connector comprising an insulative housing and a plurality of contacts assembled in the insulative housing. A one-piece retainer is assembled to the insulative housing and has protecting sections partially covering the front ends of contacting portions and upper and lower surfaces of the contacts. The retainer protects the contacting portions of the contacts from being touched unintendedly. Also, the protected contacting portions of the contacts also can avoid arc-discharge generation which is capable of influencing safe power transmission. The patent assures the contacts not to be touched from outside and also assures that the contacts not to be polluted or damaged for safe power transmission. However, the retainer is of one-piece structure and needs to align with all the contacting portions of the contacts before assembled to the insulative housing which adds the difficulty of assembly. Further, the contacting portions of the contacts are only partially covered by the retainer. The uncovered parts of the contacting portions of the contacts are still very close to the outside and easy to be polluted or damaged. Also, the one-piece structure has relative slim figure and insufficient strength which is not good enough. Further, when one contact is out of use, the whole retainer needs to be removed for repair which is not convenient enough.

Hence, it is disable to design an electrical connector and an electrical connector assembly to address problems mentioned above.

BRIEF SUMMARY OF THE INVENTION

Accordingly, an object of the present invention is to provide an electrical connector with improved protection means for providing reliable power transmission.

Another object of the present invention is to provide an electrical connector assembly with improved protection means for providing reliable power transmission.

In order to achieve the above-mentioned object, an electrical connector comprises an insulative housing, at least one contact and at least one protecting insulator. The insulative housing defines a mating direction, a mating face and a receiving cavity recessed from the mating face along said mating direction. The at least one contact is received in the insulative housing and comprises a contacting portion exposed into the receiving cavity, a retaining portion extending from one end of the contacting portion to be interferentially received in insulative housing, a forward end extending from the other end of the contacting portion to locate more closely to the mating face of the insulative housing than the contacting portion, and a connecting portion extending from the retaining portion to be exposed beyond the insulative housing. The protecting insulator entirely covers the forward end of the at least one contact.

In order to achieve the above-mentioned object, an electrical connector assembly comprises a plug connector and a receptacle connector mating with the plug connector. The plug connector comprises a first insulative housing defining a mating face and a receiving cavity recessed along a mating direction from the mating face, at leas one first contact received in the first insulative housing, and at least one protecting insulator. The at least one first contact comprises a first contacting portion exposed in the receiving cavity, a first retaining portion extending from one end of the first contacting portion and retained in the first insulative housing, a forward end extending from the other end of the first contacting portion to be closer to the mating face than the first contacting portion. The at least one protecting insulator entirely covers the forward end of the at least one contact. The receptacle connector comprises a second insulative housing, and at least one second contact received in the second insulative housing. The at least one second contact comprises an elastic second contacting portion electrically connecting with the at least one first contact. The second insulative housing is received in the receiving cavity of the first insulative housing, and the elastic second contacting portion of the at least second contact slides along the protecting insulator then forms electrical connection with the first contacting portion of the at least one first contact.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
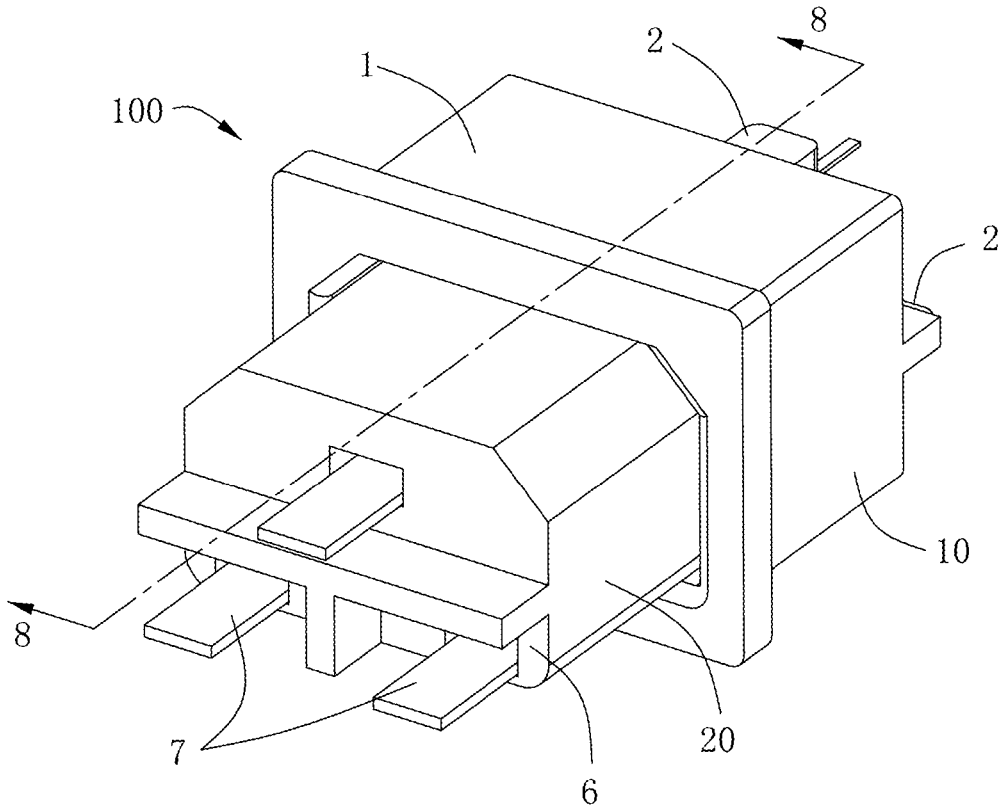
FIG. 1 is an assembled, perspective view of an electrical connector assembly in accordance with the first embodiment of the present invention, wherein a plug connector (electrical connector) and a receptacle connector (electrical connector) of the electrical connector assembly are in mating status.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-4, an electrical connector assembly 100 in accordance with the first embodiment of the present invention comprises a plug connector 10 and a receptacle connector 20 mating with each other. The plug connector 10 and the receptacle connector 20 are power connectors for power transmission in the preferred embodiment of the present invention, but the connectors are not only restricted to power type connectors. Also, the plug connector 10 and the receptacle connector 20 are the electrical connectors in accordance with the present invention.

In the first embodiment of the present invention, the plug connector 10 comprises a first insulative housing 1, a plurality of first contacts 2 attached to the first insulative housing 1, and an additional grounding contact 4 also attached to the first insulative housing 1. The receptacle connector 20 comprises a second insulative housing 6 and a plurality of second contacts 7 attached to the second insulative housing 6. The first contacts 2 and the additional grounding contact 4 electrically connect with the second contacts 7 for power transmission.

please refer to FIGS. 1-2, 4-5 and 8, the first insulative housing 1 defines a first mating face 11, a receiving cavity 12 recessed rearward from the first mating face 11, and a surrounding rib 13 enlarged from the circumferential edges of the receiving cavity 12. The receiving cavity 12 is circumscribed by opposite top wall 111 and bottom wall 112, a pair of opposite sidewalls 113, and a rear wall 114. The bottom wall 112 defines a rectangular recess 14 behind the surrounding rib 13. A plurality of horizontal and vertical partition racks 115 extend into the receiving cavity 12 to divide the receiving cavity 12 into three first contact-receiving passageways 121 arranged in triangle relationship for receiving the first contacts 2 and penetrating through the rear wall 114. The horizontal and vertical partition racks 115 connect with one another to assure that at least two adjacent sides of each first contact 2 are surrounded by the partition racks 115.

Figure 5:
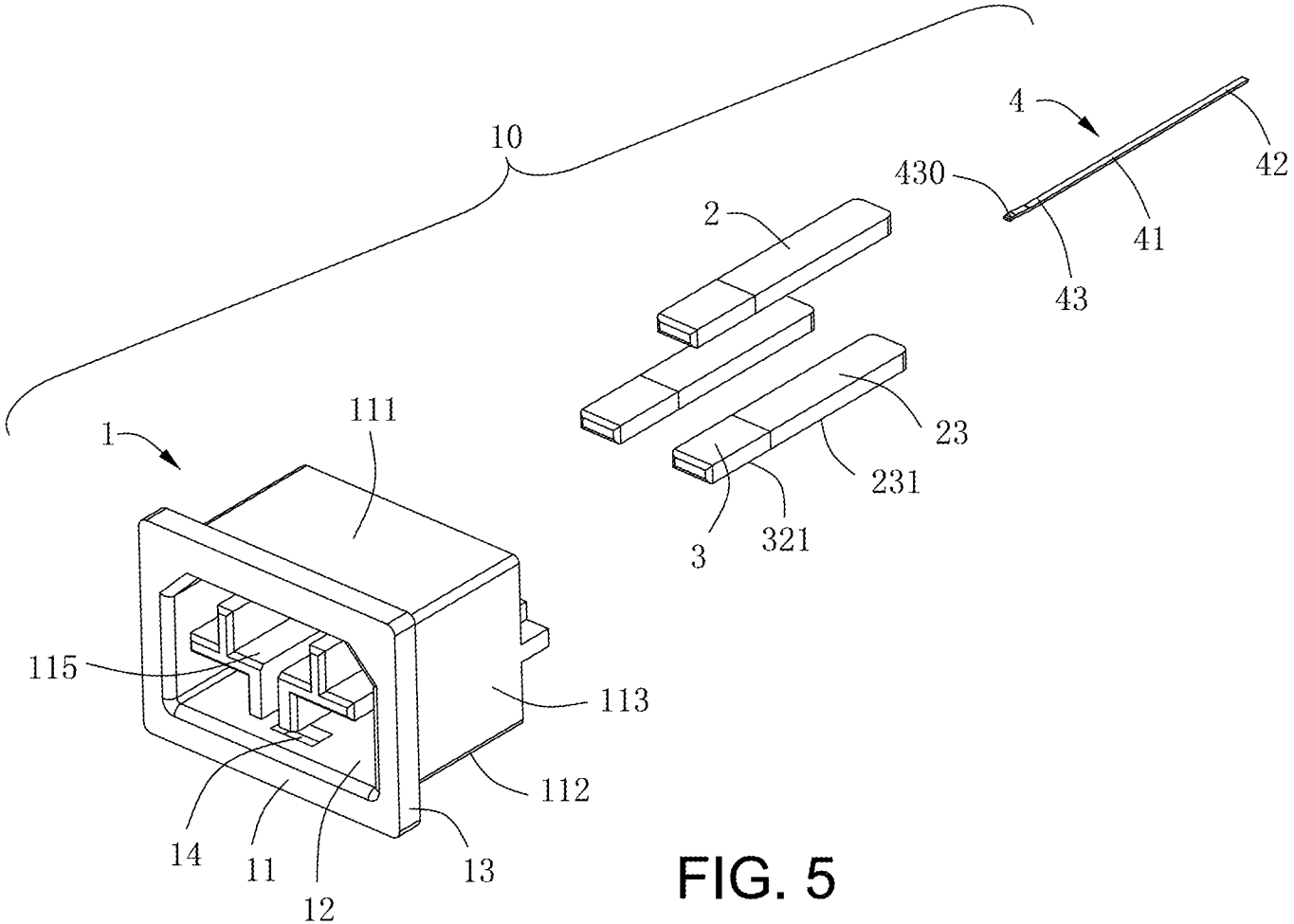
FIG. 5 is an exploded, perspective view of the plug connector in accordance with the first embodiment of the present invention.
Figure 6:
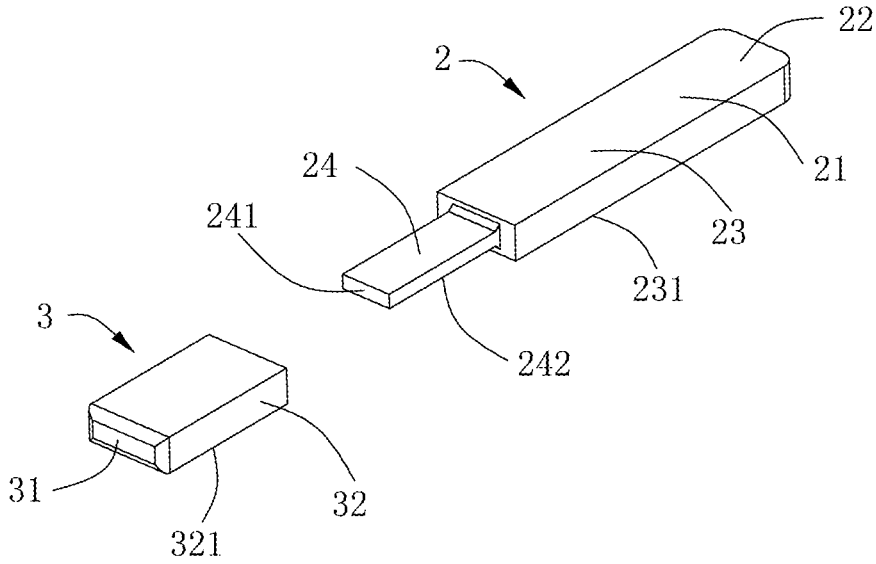
FIG. 6 is an exploded, perspective view of a first contact and a protecting insulator of the plug connector.
Figure 8:
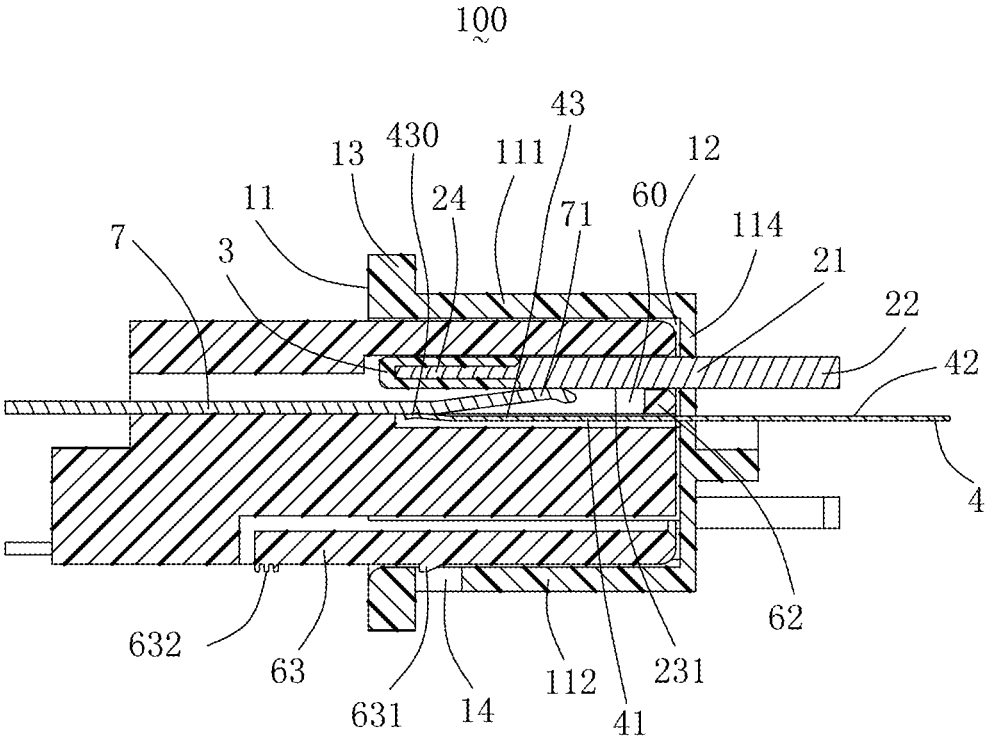
FIG. 8 is a cross-section view taken along line 8-8 of FIG. 1.
Figure 9:
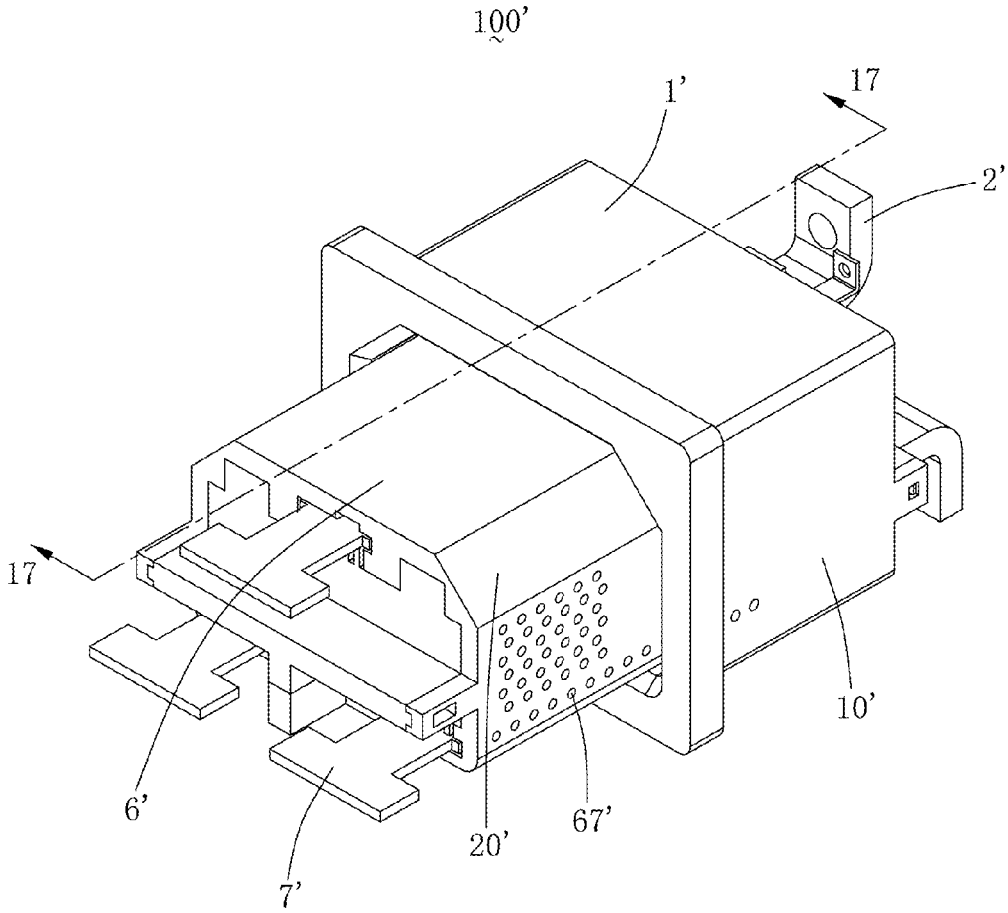
FIG. 9 is an assembled, perspective view of an electrical connector assembly in accordance with the second embodiment of the present invention.
Figure 10:
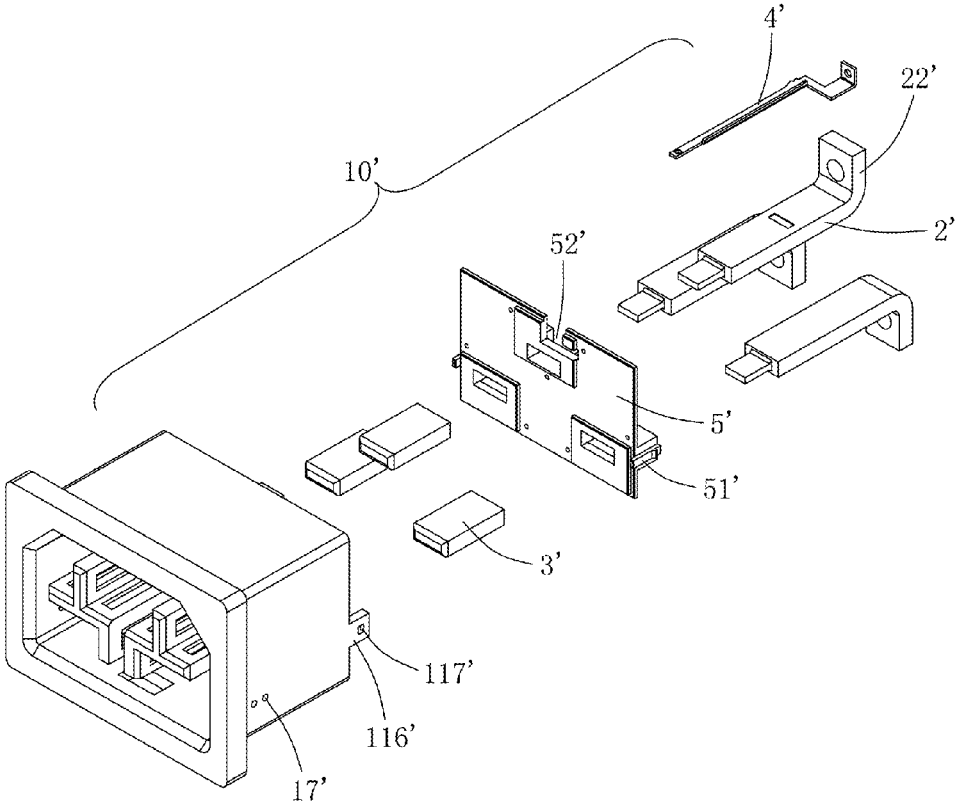
FIG. 10 is an exploded, perspective view of a plug connector in accordance with the second embodiment of the present invention.
Figure 11:
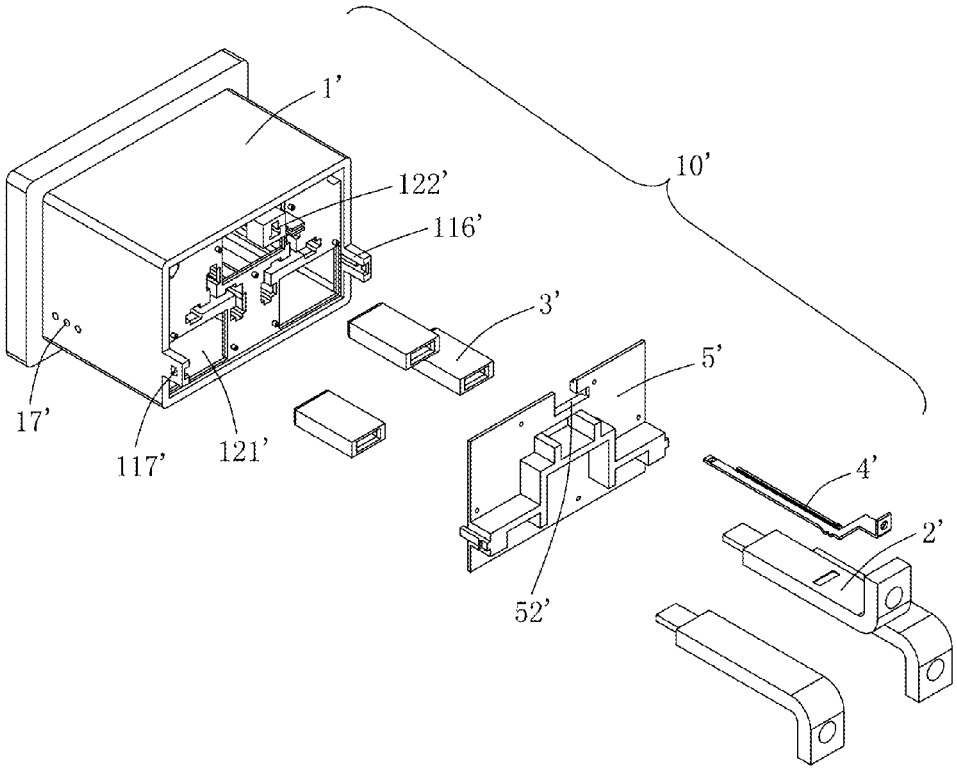
FIG. 11 is a view similar to FIG. 10, but viewed from a different aspect.
Figure 12:
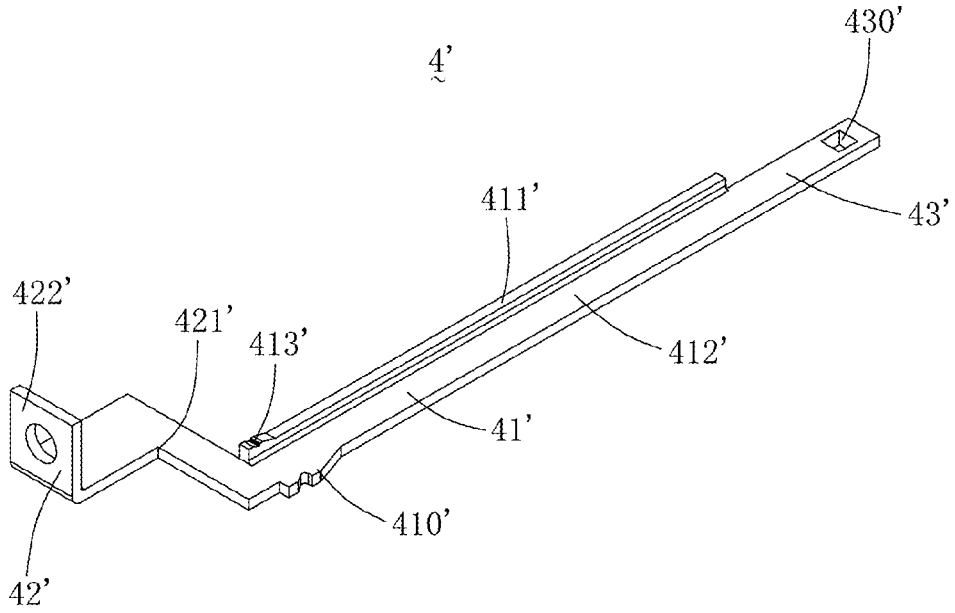
FIG. 12 is a perspective view of an additional grounding contact of the plug connector.
Figure 13:
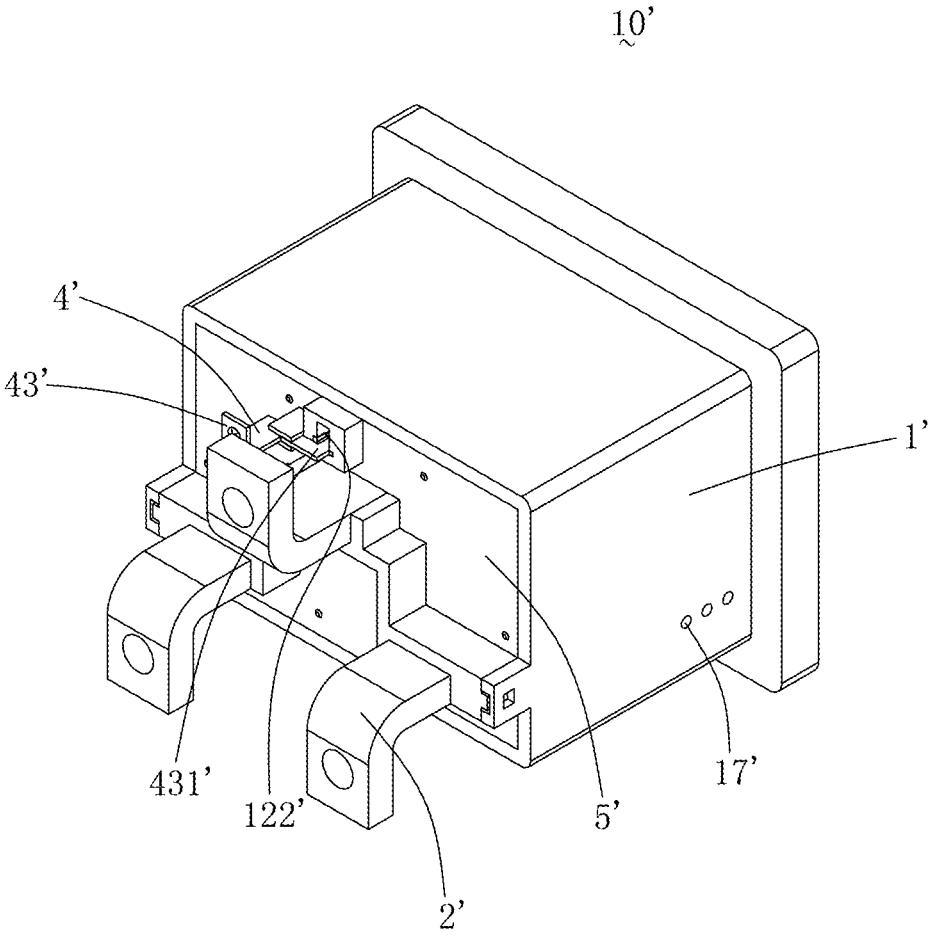
FIG. 13 is an assembled, perspective view of the plug connector in accordance with the second embodiment of the present invention.

Please refer to FIGS. 5-6 and 8, the first contacts 2 are three power contacts arranged in triangle relationship and received in the first contact-receiving passageways 121. The two first contacts 2 aligning with each other and arranged on the same horizontal line are a positive contact and a negative contact in power transmission. The first contact 2 located at the top of the triangle is a grounding contact in power transmission. Each first contact 2 is of straight shape with a certain height and comprises a first retaining portion 21 interferentially engaged with the rear wall 114 of the first insulative housing 1, a first connecting portion 22 extending rearward from the first retaining portion 21 to be exposed beyond the rear wall 114 for electrically connecting with wires (not shown), a flat first contacting portion 23 extending forward from the first retaining portion 21, and a forward end 24 extending forward from the first contacting portion 23 (FIG. 6). The forward end 24 is shrunk from the first contacting portion 23 with width and thickness both smaller that those of the first contacting portion 23. The first contacting portion 23 has a contacting surface 231 behind the forward end 24. When the first contacts 2 are retained in the first insulative housing 1, the contacting portions 23 and the forward ends 24 are all exposed in the receiving cavity 12, the connecting portions 22 extend beyond the rear wall 114. The forward end 24 has a front face 241 close to the first mating face 11 and an extending face 242 located at the same side as that of the contacting surface 231.

Since the forward ends 24 are located closer to the first mating face 11, the forward ends 24 are easier to be touched by fingers or other things, or covered by dust from outside, all cause the forward ends 24 (especially the front faces 241 thereof) are prone to be polluted or damaged, further influence the stability of power transmission or raise unsafe problems. Please refer to FIGS. 5 and 6, a protecting insulator 3 is overmolded with the forward end 24 of the first contact 2 in the preferred embodiment of the present invention which protects the forward end 24 from the problems described above. Of course, in an alternative embodiment, the protecting insulators 3 also can be assembled to the forward ends 24 of the first contacts 2. The protecting insulator 3 is a hollow cuboid with one open end toward the forward end 24 of the first contact 2. The protecting insulator 3 comprises a front end portion 31 covering the front face 241 of the forward end 24 and a cover portion 32 extending rearward from the end portion 31 to cover the extending faces 242. Therefore, the insulated area is extended into inner section of the receiving cavity 12 which protects the contacting portion 23 from being polluted or damaged. The problems addressed above are solved to assure stability of power transmission and safety.

In addition, the outer surface 321 of the cover portion 32 is coplanar with the contacting surface 231 for assuring the stability of the second contact 7 of the receptacle connector 20 sliding along the outer surface 321 and the contacting surface 231.

Please refer to FIGS. 5 and 8, the additional grounding contact 4 is longitudinal and located below the grounding first contact 2 and together received in the same first contact-receiving passageway 121 with the grounding first contact 2. The additional grounding contact 4 comprises an additional retaining portion 41 retained in the first insulative housing 2, an additional connecting portion 42 extending rearward from the additional retaining portion 41 and beyond the first insulative housing 2, and an additional contacting portion 43 extending forward from the additional retaining portion 41 and forming a contacting end 430 curved upward slightly. The contacting end 430 is located below a front section of the outer surface 321 of the protecting insulator 3 to assure that the additional grounding contact 4 electrically contacts the grounding second contact 7 of the receptacle connector 20 after the grounding first contact 2. That means, the additional grounding contact 4 and the grounding first contact 2 form electrical connection with the same grounding second contact 7. Thus, the additional grounding contact 4 is a spare grounding contact to assure an always grounding function even when the grounding first contact 2 is invalid. The grounding function is very important for high-power, high-voltage power connectors.

Figure 2:
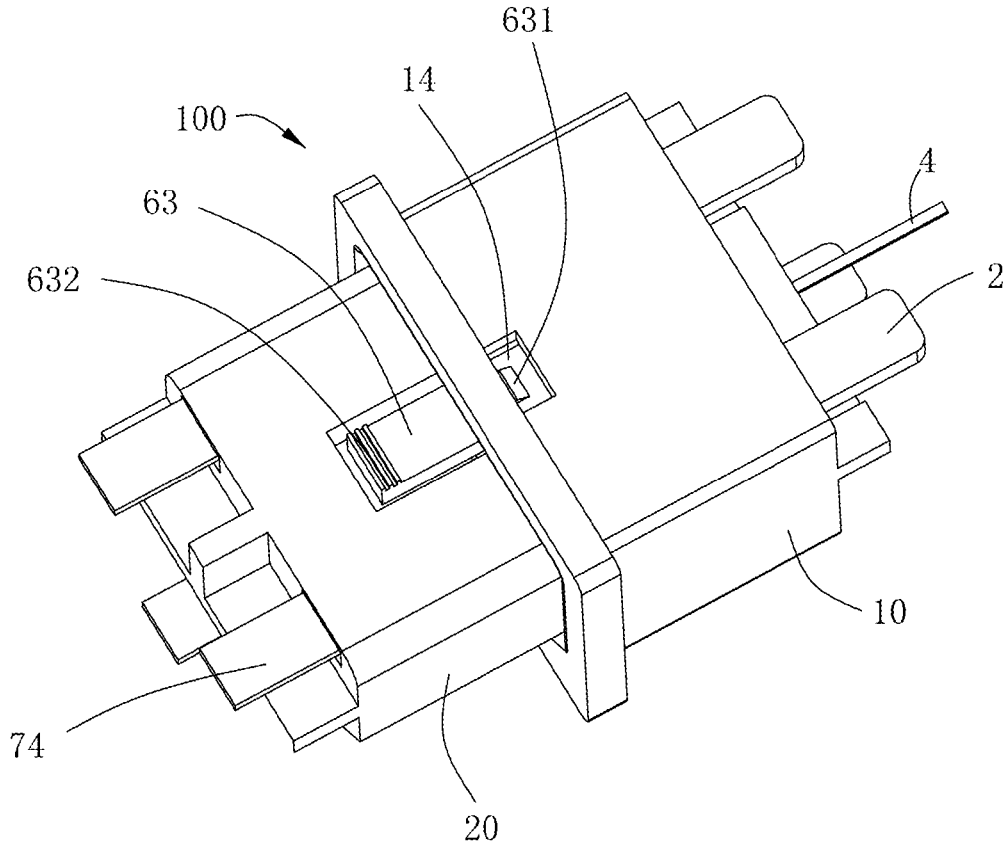
FIG. 2 is a view similar to FIG. 1, but viewed from a different aspect.
Figure 3:
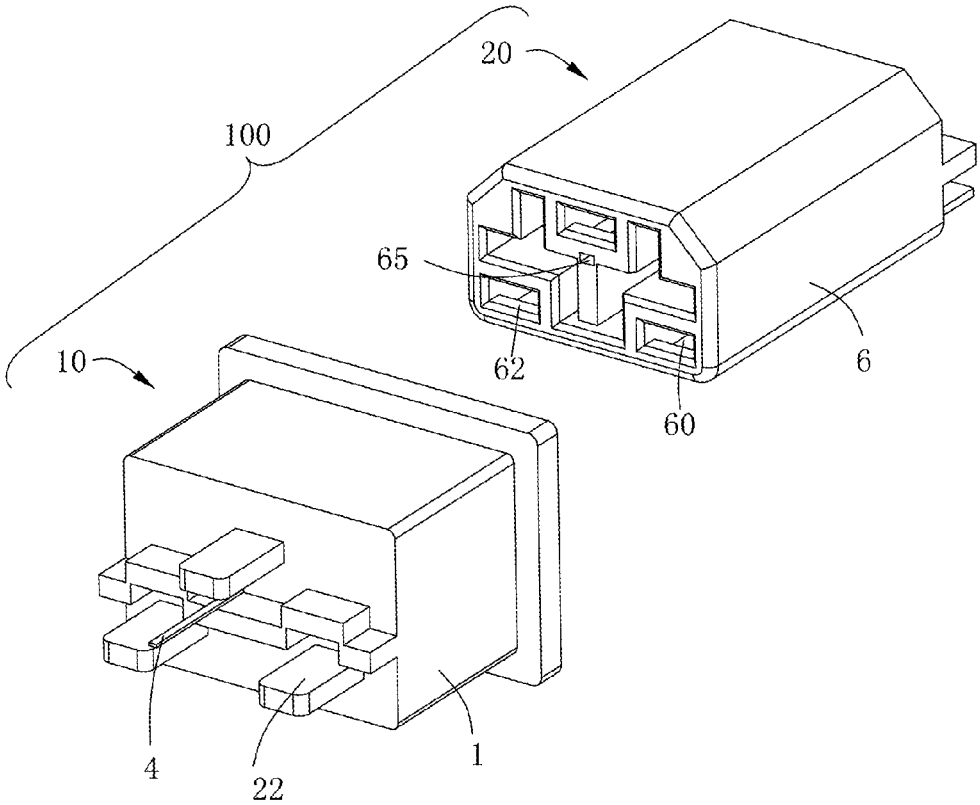
FIG. 3 is a perspective view of the electrical connector assembly with the plug connector and the receptacle connector in separate status.
Figure 4:
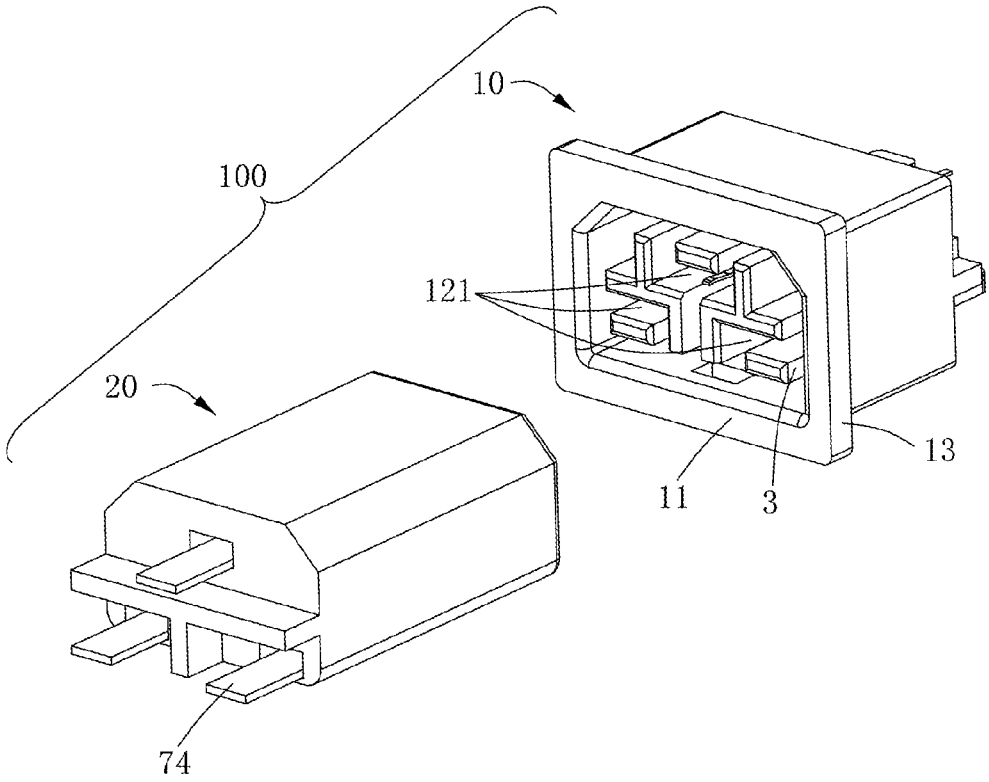
FIG. 4 is a view similar to FIG. 3, but viewed from a different aspect.
Figure 7:
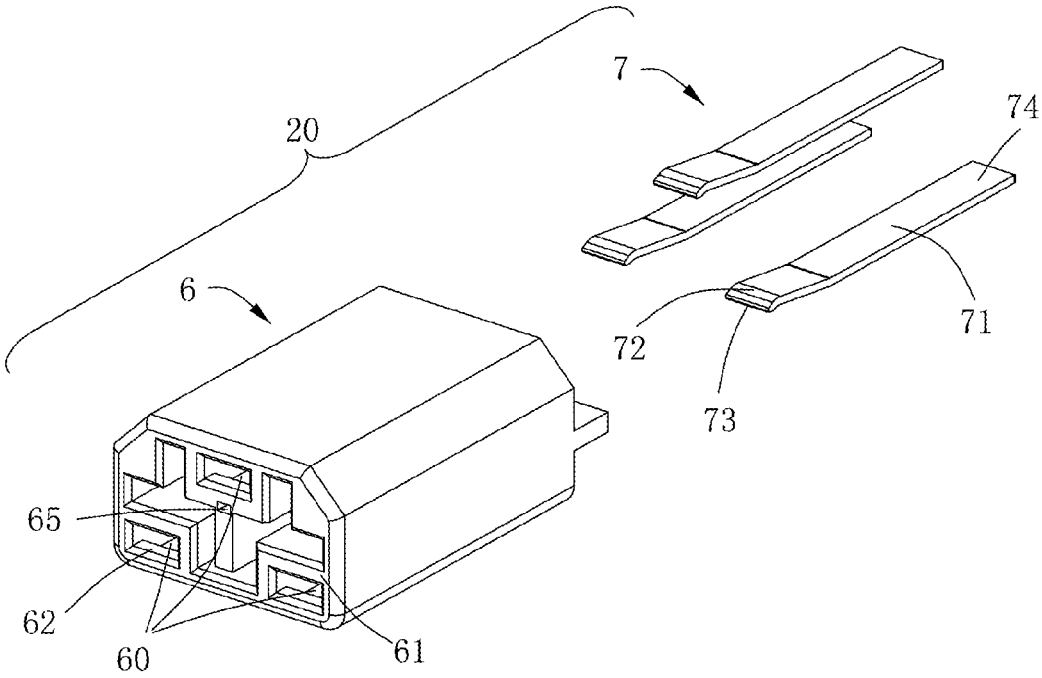
FIG. 7 is an exploded, perspective view of the receptacle connector (electrical connector) in accordance with a first embodiment of the present invention.

Please refer to FIGS. 2 and 7-8, the second insulative housing 6 comprises a second mating face 61 and a plurality of second contact-receiving passageways 60 recessed forward from the second mating face 61. A protection block 62 protrudes upward from a bottom surface of each second contact-receiving passageway 60 and extends forward from the second mating face 60 into the second contact-receiving passageway 60 a certain distance. In FIGS. 2 and 8, a latch arm 63 is disposed at a bottom of the second insulative housing 6 for latching with the recess 14 of the first insulative housing 1. The latch arm 63 comprises a latch section 631 and a pressing section 632 respectively at opposite ends of the latch arm 63.

The second contact 7 comprises a flat second retaining portion 71 retained in the second insulative housing 6, an elastic second contacting portion 72 extending rearward from the second retaining portion 71 and bending upwardly slightly, and a second connecting portion 74 extending forward from the second retaining portion 71 beyond the second insulative housing 6 for electrically connecting with wires (not shown). The second contacting portion 72 comprises an elastic contacting free end 73 with certain deformation ability. In FIG. 8, when the second contacts 7 are retained in the second insulative housing 6, the elastic second contacting portions 72 extend beyond upper surfaces of the protection blocks 62. While, when the plug connector 10 and the receptacle connector 20 mate with each other, the elastic second contacting portions 72 are compressed by the contacting surfaces 231 of the second contacts 2. The free ends 73 are compressed to be below the upper surfaces of the protection blocks 62, thus, the second contacts 7 are prevented from being touched or damaged by outside. Correspondingly, the second contacts 7 also comprise three power contacts in triangle relationship in the preferred embodiment of the present invention, a positive second contact, a negative second contact and a grounding second contact 7 located at the top point of the triangle. Of course, the three second contact-receiving passageways 60 are also arranged in triangle relationship with the top second contact-receiving passageway 60 defines an additional contact-receiving passageway 65 at the bottom thereof to protrude through the protection block 62.

Please refer to FIG. 8, when the plug connector 10 mates with the receptacle connector 20, the second insulative housing 6 is received in the receiving cavity 12 of the first insulative housing 1. The protection blocks 62 guide the first contacts 2 into the second contact-receiving passageways 60 to form electrical connection with the second contacts 7. During the mating process, the elastic second contacting portion 72 slides along the outer surface 321 of the cover portion 32 firstly and then slide beyond the cover portion 32 to finally form electrical connection with the contacting surface 231 of the first contacting portion 23. At the same time, the latch section 631 of the latch arm 63' protrudes into the recess 14 of the first insulative housing 1 to improve the retention force between the plug connector 10 and the receptacle connector 20. The additional grounding contact 4 protrudes through the additional contact-receiving passageway 65 to contact the grounding second contact 7 after the grounding first contact 2 contacts the grounding second contact 7.

When need to separate the plug connector 10 and the receptacle connector 20, user just needs to press the pressing section 632 of the latch arm 63 downward, the latch section 631 is caused to be separated from the recess 14. In alternative embodiments, the latch arm 63 also can be disposed on the first insulative housing 1 of the plug connector 10 and the recess 14 is defined in the second insulative housing 6 which also can realize the same purpose. The first contacts 2 can be assembled to or insert-molded with the first insulative housing 1, and the second contacts 7 also can be assembled to or insert-molded with the second insulative housing 6. In addition, the additional grounding contact 4 also can be disposed in the second insulative housing 6 of the receptacle connector 20 after a skilled person in the art makes some simple changes to the second insulative housing 6.

FIGS. 9-17 disclose a second embodiment of the present invention, a plug connector 10' and a receptacle connector 20' of an electrical connector assembly 100' have similar designs as described in the first embodiment. Hence, only differences will be introduced hereinafter.

Compared with the plug connector 10, the plug connector 10' has different first contact structure. The first contacts 2' have different first connecting portions 22' which bend upward (for grounding first contact 2') and downward (for power first contacts 2'). The plug connector 10' also comprises a first retainer 5' insert-molded with the first contacts 2' together to form a first contact module. The protecting insulators 3' are firstly insert-molded with the forward ends 24' of the first contacts 2', then the first retainer 5' is insert-molded with the first contacts 2 and together assembled to the first insulative housing 1'. The first retainer 5' is assembled to a rear end of the first insulative housing 1' and has a pair of latch means 51' on opposite lateral sides thereof to latch into a pair of through holes 117' of locking means 116' of the first insulative housing 1'. An L-shape cutout 52' is recessed downward from a top edge of the first retainer 5' for penetration of the additional grounding contact 4'. The first insulative housing 1' defines an additional contact-receiving passageway 122' with a front end thereof communicating with the top first contact-receiving passageway 121'.

The additional grounding contact 4' comprises an additional retaining portion 41', a flat additional contacting portion 43' extending forward from the additional retaining portion 41', and an additional connecting portion 42' extending rearward from the additional retaining portion 41'. The additional contacting portion 43' penetrates through the additional contact-receiving passageway 122' to be exposed in the top first contact-receiving passageway 121' together with the grounding first contact 2'. A contacting end 430' is stamped with a bump to electrically contact the grounding second contact 7' of the receptacle connector 20'. The additional retaining portion 41' comprises a main portion 412' located in a horizontal surface and a rib 411' extending vertically from one edge of the main portion 412' to locate in a vertical surface. A plurality of first barbs 410' and a plurality of second barbs 413' are respectively formed at rear ends of the main portion 412' and the rib 411' to interferentially engage with inner walls of the additional contact-receiving passageways 122' for retaining the additional grounding contact 4' in the first insulative housing 1'. The additional connecting portion 42' comprises an L-shape extended section 421' mainly located in a horizontal surface and extending from the additional retaining portion 41', and a connecting section 422' bending upwardly from the extended section 421'.

Figure 14:
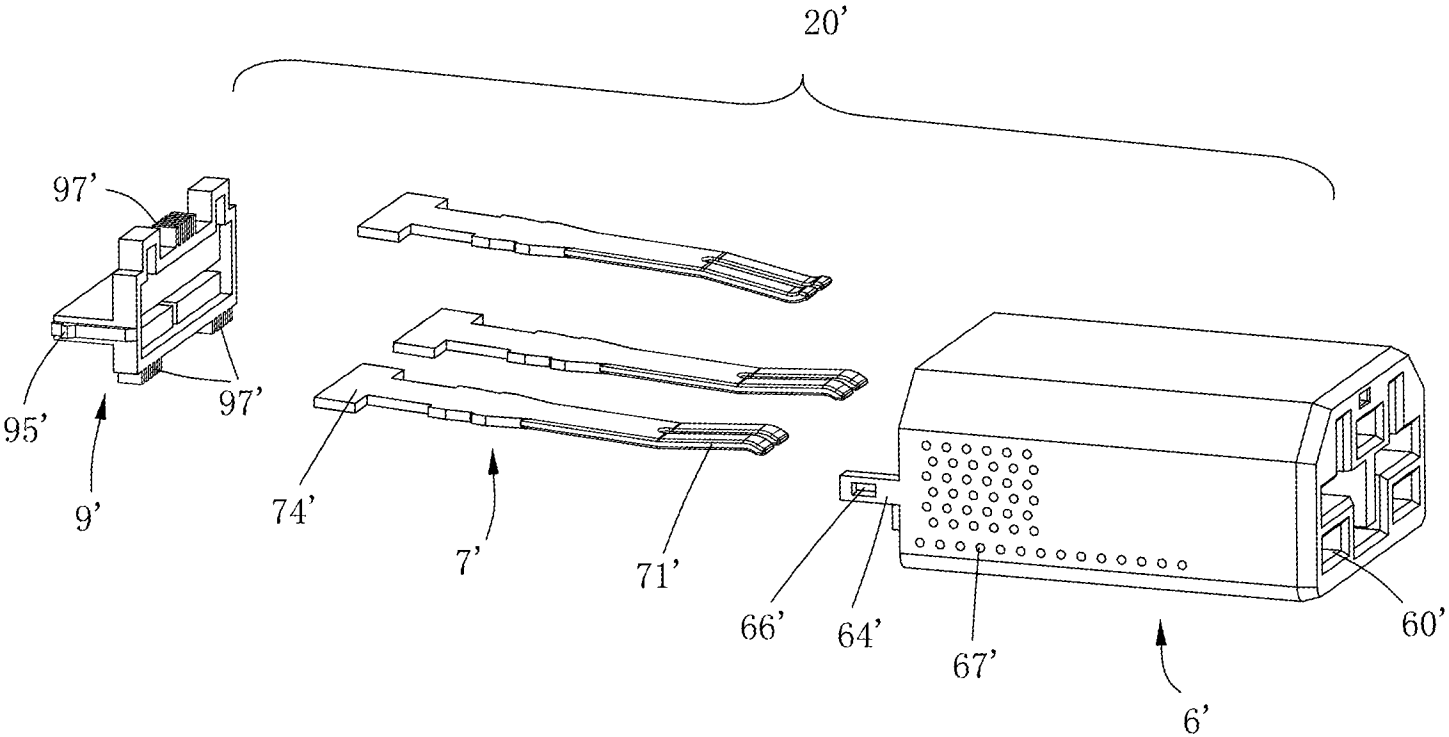
FIG. 14 is an exploded, perspective view of the receptacle connector in accordance with the second embodiment of the present invention.
Figure 15:
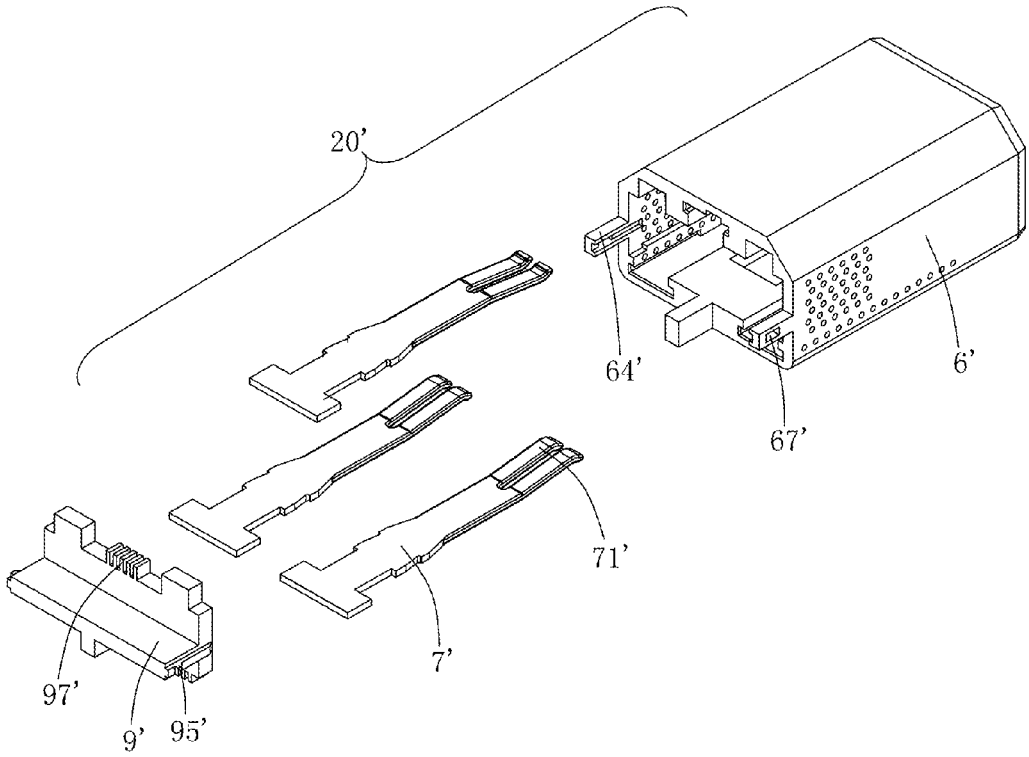
FIG. 15 is a view similar to FIG. 14, but viewed from a different aspect.
Figure 16:
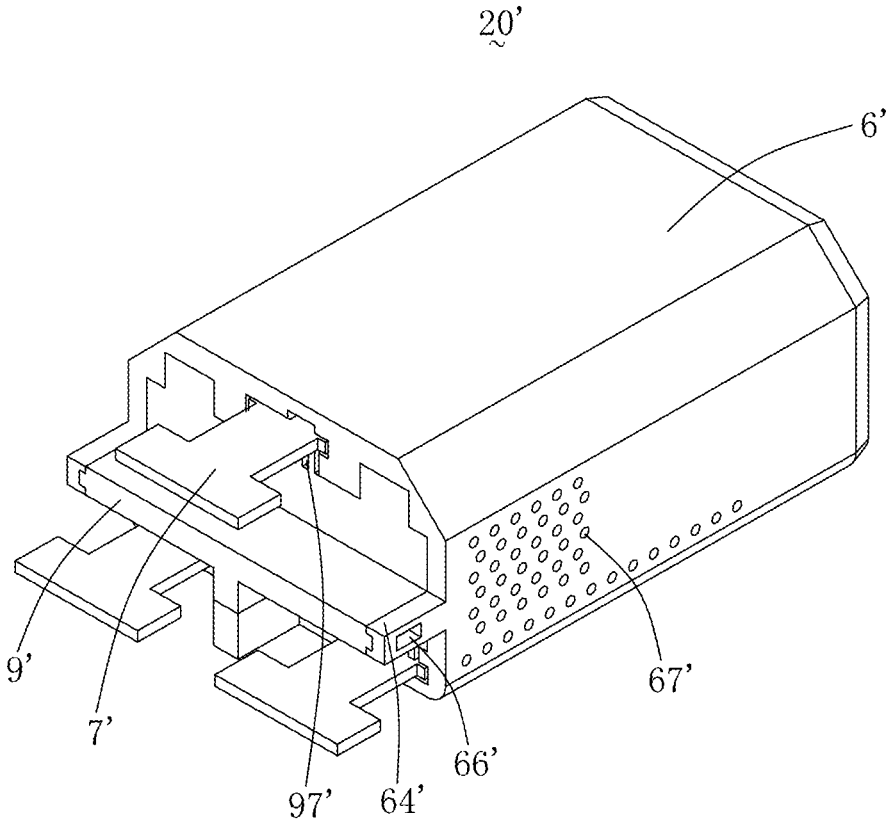
FIG. 16 is an assembled, perspective view of FIG. 15.
Figure 17:
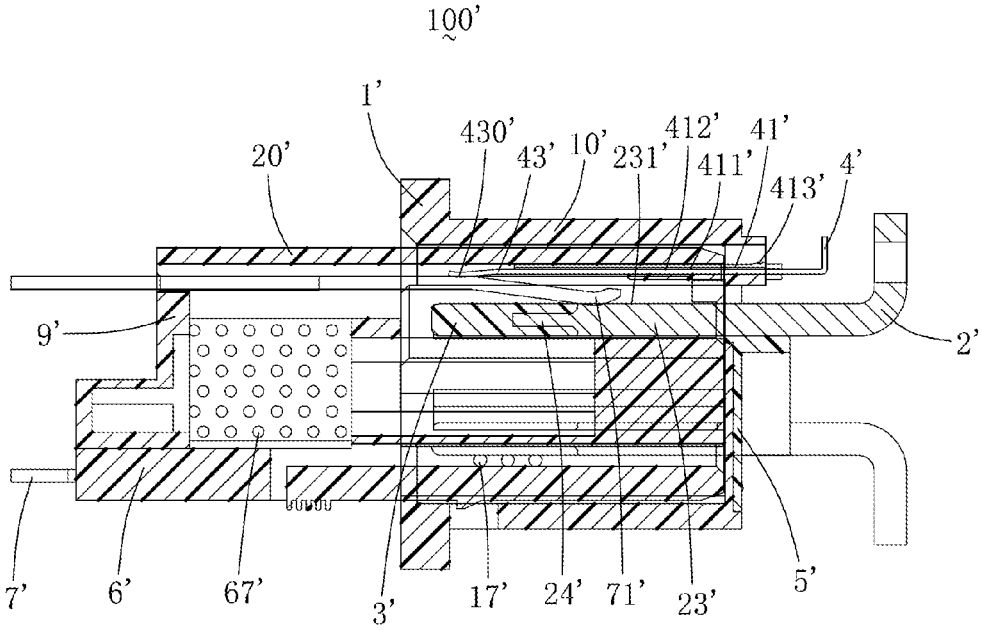
FIG. 17 is a cross-section view taken along line 17-17 of FIG. 9.

FIGS. 14-16 disclose the receptacle connector 20'. Compared with the receptacle connector 20, the receptacle connector 20' further comprises a second retainer 9' retaining the second contacts 7' together with the second insulative housing 6'. The second retainer 9' is assembled to the second insulative housing 6' after the second contacts 7' are assembled to be received in the second contact-receiving passageways 60' of the second insulative housing 6'. The second contacts 7' are sandwiched between the second retainer 9' and the second insulative housing 6' to provide better support to the second connecting portions 74'. The second retainer 9' forms a pair of latch means 95' on opposite lateral sides to lock into through holes 66' of a pair of locking means 64' of the second insulative housing 6' to attach the second retainer 9' tightly to the second insulative housing 6'. Further, the second contacting portion 71' is of bifurcated shape to improve elasticity thereof.

Since the plug connector 10, 10' and the receptacle connector 20, 20' are high-power power connectors, heat radiation issue must be considered. In the second embodiment of the present invention, heat-radiation structures are designed. The first insulative housing 1' defines a plurality of heat-radiating holes 17' to communicate with at least one first contact-receiving passageway 121', while, the second insulative housing 6' defines a plurality of heat-radiating holes 67' to communicate with at least one second contact-receiving passageway 60'. In addition, the second retainer 9' also defines a plurality of heat-radiating passages 97' to communicate with at least one second contact-receiving passageway 60'. These heat-radiating structures 17', 67' and 97' communicate the first and second contact-receiving passageways 121', 60' with outside to radiate heat generated by mated first and second contacts 2', 7' to the outside in time to satisfy the heat-radiating requirement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector adapted for electrically connecting with a complementary connector, comprising:

an insulative housing defining a mating direction, a mating face and a receiving cavity recessed from the mating face along said mating direction;

a plurality of contacts received in the insulative housing adapted for electrically connecting with contacts of the complementary connector, each of the contacts comprising a contacting portion exposed into the receiving cavity adapted for electrically connecting with the respective contact of the complementary connector, a retaining portion extending from one end of the contacting portion to be interferentially received in the insulative housing, a forward end extending from the other end of the contacting portion to locate more closely to the mating face of the insulative housing than the contacting portion, and a connecting portion extending from the retaining portion to be exposed beyond the insulative housing; and a protecting insulator entirely covering the forward end of each one of the contacts;

wherein the insulative housing forms a plurality of partition racks extending into the receiving cavity to separate the receiving cavity into a plurality of contact-receiving passageways, and wherein the contacts are respectively received in the contact-receiving passageways and spaced from one another by the partition racks.

2. The electrical connector as claimed in claim 1, wherein the protecting insulator is inset-molded/assembled to the forward end of the respective contact.

3. The electrical connector as claimed in claim 1, wherein the forward end is shrunk forwardly from the contacting portion, and wherein the protecting insulator covering the forward end has outer surfaces respectively coplanar with those of the contacting portion.

4. The electrical connector as claimed in claim 1, wherein the electrical connector comprises three contacts for power transmission, each contact has a forward end covered by a protecting insulator.

5. The electrical connector as claimed in claim 4, wherein the contacts are arranged in triangle relationship with a positive contact and a negative contact arranged on the same line, while a grounding contact is arranged at the top of the triangle.

6. The electrical connector as claimed in claim 5, further comprising an additional grounding contact assembled to the insulative housing to locate below the grounding contact.

7. The electrical connector as claimed in claim 6, wherein the grounding contact and the additional grounding contact electrically connect with the same contact of the complementary connector, and wherein the additional grounding contact forms electrical connection with said contact of the complementary connector later than the grounding contact.

8. The electrical connector as claimed in claim 6, wherein the additional grounding contact comprise an additional contacting portion, an additional retaining portion interferentially received in the insulative housing and an additional connecting portion exposed beyond the insulative housing.

9. The electrical connector as claimed in claim 5, further comprising an additional grounding contact assembled to the same contact-receiving passageway together the grounding contact adapted for electrically connect with the same contact of the complementary connector.

10. The electrical connector as claimed in claim 5, further comprising a retainer assembled to the insulative housing to hold the contacts together with the insulative housing.

11. The electrical connector as claimed in claim 10, wherein the retainer is insert-molded with the contacts and assembled to the insulative housing together with the contacts.

* * * * *